United States Patent [19]

Leonard

[11] 4,429,629

[45] Feb. 7, 1984

[54] PRESS CONSTRUCTION

[76] Inventor: Frank W. Leonard, P.O. Box 5634, Boise, Id. 83705

[21] Appl. No.: 310,617

[22] Filed: Oct. 13, 1981

[51] Int. Cl.[3] ..... B30B 7/00

[52] U.S. Cl. ..... 100/226; 100/52; 100/256; 100/269 A; 100/913

[58] Field of Search ..... 100/913, 269 A, 226, 100/232, 256, 52, 269 R; 83/590, 639; 72/453.09, 453.12, 453.01

[56] References Cited

U.S. PATENT DOCUMENTS

| | | | |
|---|---|---|---|
| 1,894,156 | 1/1933 | Byington | 100/269 R X |
| 2,363,779 | 11/1944 | Duffy | 100/269 A |
| 3,207,406 | 9/1965 | Bowman | 100/269 R X |
| 3,713,381 | 1/1973 | Mort | 100/269 R X |
| 3,939,765 | 2/1976 | Jung | 100/269 A X |
| 4,351,223 | 9/1982 | Leonard | 100/269 A X |

FOREIGN PATENT DOCUMENTS

| | | | |
|---|---|---|---|
| 696355 | 8/1953 | United Kingdom | 100/269 A |

*Primary Examiner*—Billy J. Wilhite
*Attorney, Agent, or Firm*—Eugene M. Eckelman

[57] ABSTRACT

A vertical support frame has a top reinforced surface forming a first platen surface. A second platen assembly is movable vertically in the support frame and has a surface above the first platen surface forming a second platen surface. Air bags are disposed between the frame and the second platen assembly in an arrangement to lift the second platen assembly to open the press and also to pull the second platen assembly down to close the press. The second platen assembly includes a retractable carriage for moving the second platen surface rearwardly for loading the press. A multiple bag arrangement is also within the concept of the invention and serves to position pressing surfaces directly over the first platen surface. Operating controls are provided to move the carriage platen between forward and retracted positions and also for controlling operation of the fluid operated bags to cause alternate expansion and contraction thereof in the opening and closing of the press.

21 Claims, 8 Drawing Figures

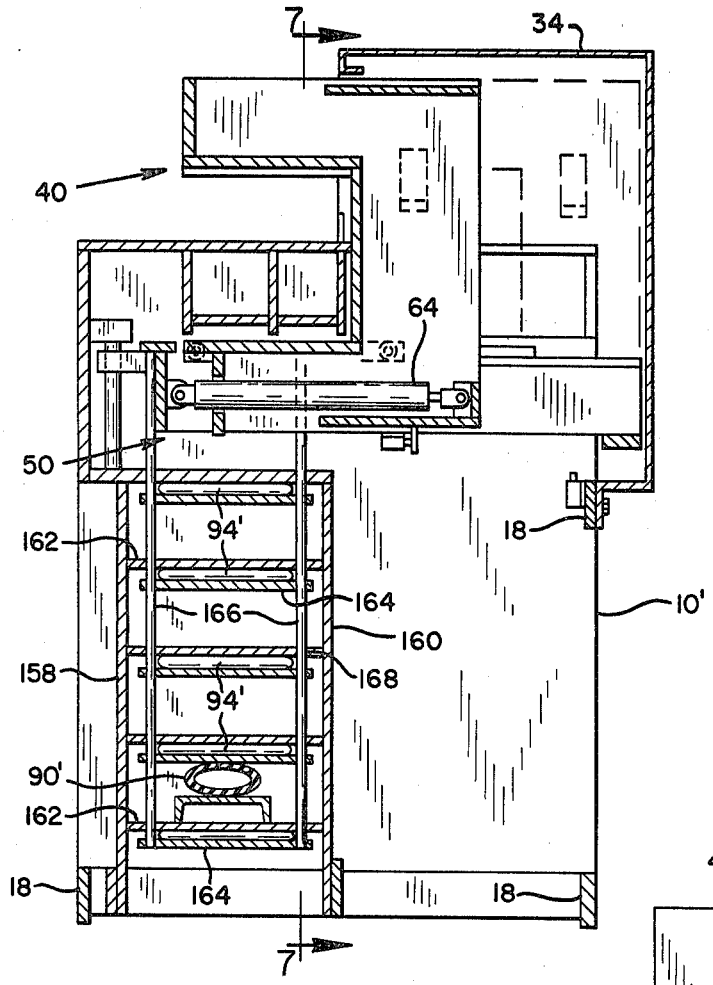
FIG. 6
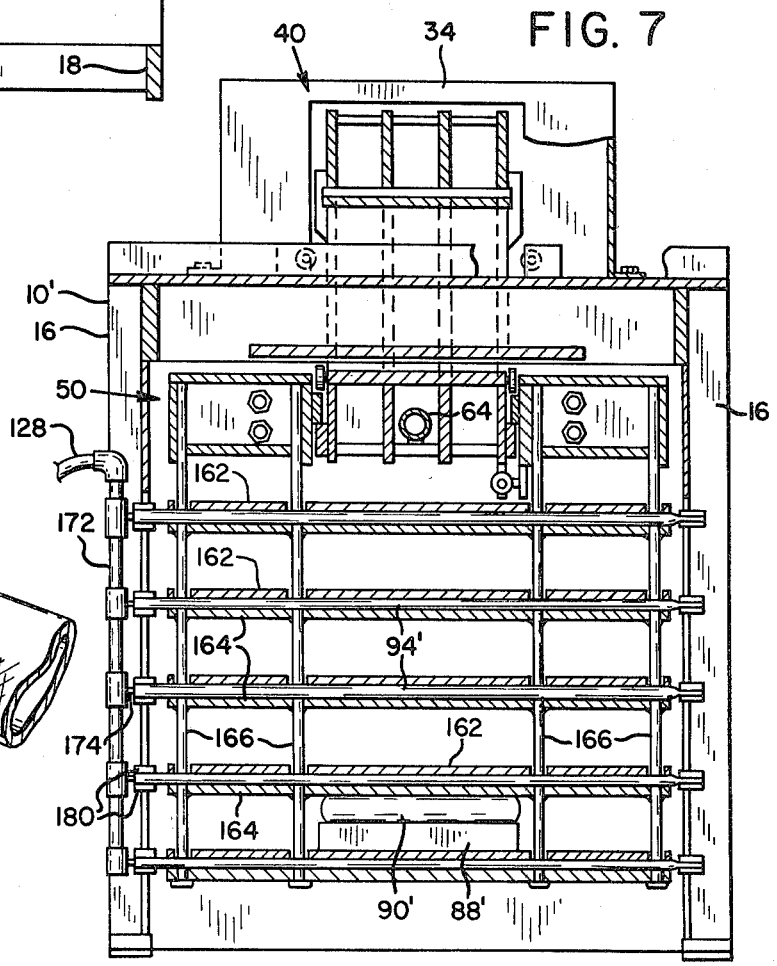
FIG. 7
FIG. 8
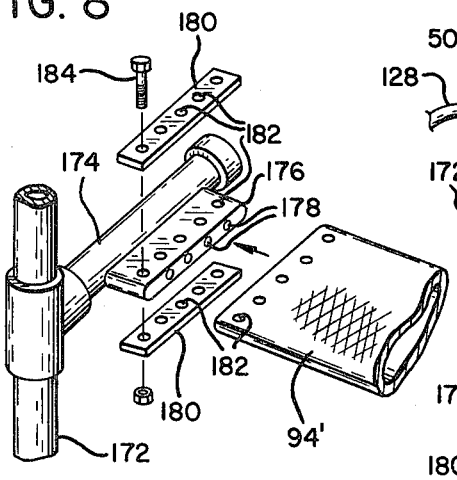

PRESS CONSTRUCTION

FIELD OF THE INVENTION

This invention relates to new and useful improvements in press constructions and is particularly concerned with a press structure of the type that is opened and closed for each pressing operation.

SUMMARY OF THE INVENTION

A primary objective of the present invention is to provide a press construction having a novel cabinet structure as well as novel internal pressing structure, such cabinet and internal pressing structure providing strong support for a stationary platen and for a movable platen assembly in all functions of a pressing operation; also such structure contributes to convenient access to the interior of the cabinet and also provides interior room for mounting plumbing fixtures and control devices within the cabinet.

Another object is to provide a press construction including a stationary platen surface that is disposed for convenient loading and unloading of the press, and a horizontal movable platen capable of retracting while the press is being loaded and unloaded.

Another object is to provide a press construction employing a pair of fluid operated expandable bags which open and close the press in an efficient and fast press operation.

Another object is to provide a press construction of a structure that utilizes two or more fluid operated expandable bags to achieve increased pressing power over that possible from a single fluid operated expandable bag. It is also an object of such multiple bag arrangement to concentrate the lifting power directly centered under the pressing area whereby to prevent uneven pressing forces from being imparted by the press and also to prevent twisting forces from developing in the frame of the press.

Another object is to provide a press construction having a novel combination of operator's station and pressing surface such that multiple presses can be positioned selectively in a factory and multiple-joint structural elements formed in one operation.

Still another object is to provide a press construction having guided vertical movement of a movable platen assembly to facilitate precise movement of the movable platen assembly in a closing movement of the press.

In accomplishing these objectives, the press construction includes a cabinet-type vertical support frame having a top reinforced surface forming a first platen surface. A second platen assembly is movable vertically in the support frame and has a portion thereof disposed above the first platen surface serving as a platen surface arranged to cooperate with the latter for pressing articles. A pair of fluid operated expandable bags are contained in the mechanism and operate both to move the second platen assembly to an upper open press position and to pull the second platen assembly downward in a pressing operation. The second platen surface is on a carriage movable on a carriage support of the second platen assembly having depending arms extending to a lower portion of the support frame and integrated with a lower floor portion against which one or more of the fluid operated expandable bags bears for closing the press. The cabinet includes reinforced integral side walls which support stationary portions of the press as well as the carriage throughout all functions of the operation of the press. The particular construction of the cabinet as well as the specific arrangement of the second platen assembly forms an area within the cabinet convenient for mounting operating and control mechanism and for convenient access to such area. Guide means are provided between the support frame and the second platen assembly to guide the latter in a stable vertical direction. Power means are associated with the fluid operated expandable bags as well as with the carriage for operating these portions, and such power means have a novel control and function for closing the press, raising and lowering of the second platen assembly, and opening of the press.

A modified structure of the press is provided that uses multiple fluid operated expandable bags for increasing pressing power.

The invention will be better understood and additional objects and advantages will become apparent from the following description taken in connection with the accompanying drawings.

BRIEF DESCRIPTION OF THE DRAWINGS

FIG. 6 is a vertical sectional view of a second form of press construction embodying features of the instant invention, this view being taken similar to FIG. 2 of the first embodiment;

FIG. 7 is a vertical sectional view taken on the line 7—7 of FIG. 6; and FIG. 8 is an enlarged exploded view of connector structure for a fluid operated expandable bag used in the embodiment of FIGS. 6 and 7 and a supply manifold therefor.

DETAILED DESCRIPTION OF A PREFERRED EMBODIMENT

Figure 1:
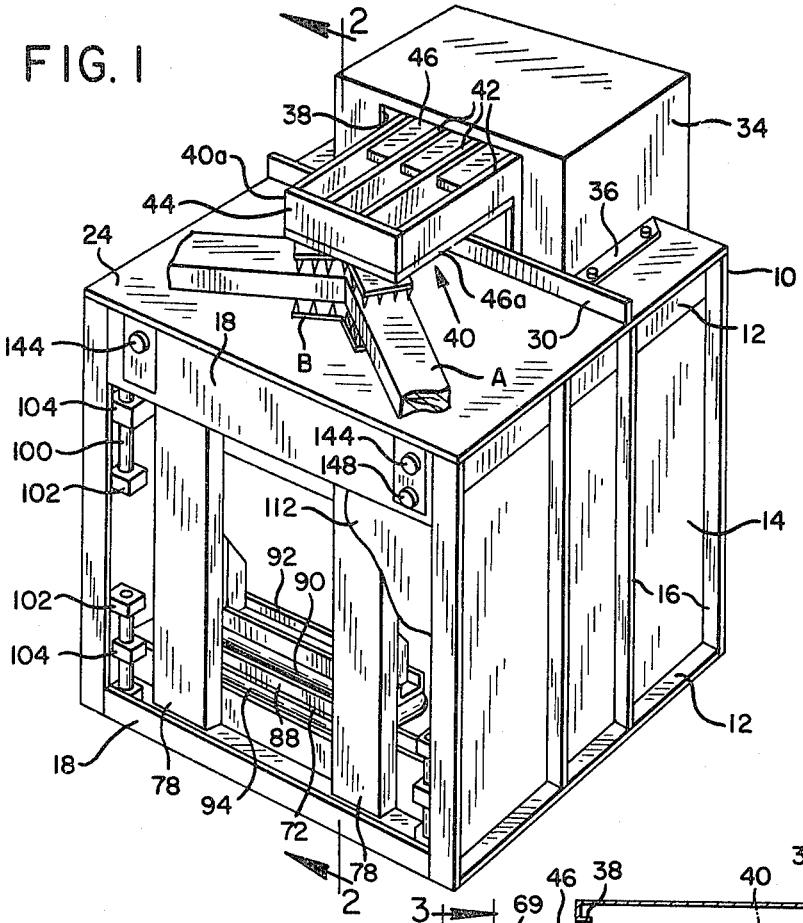
FIG. 1 is a perspective view of a first form of press construction embodying features of the instant invention.
Figure 2:
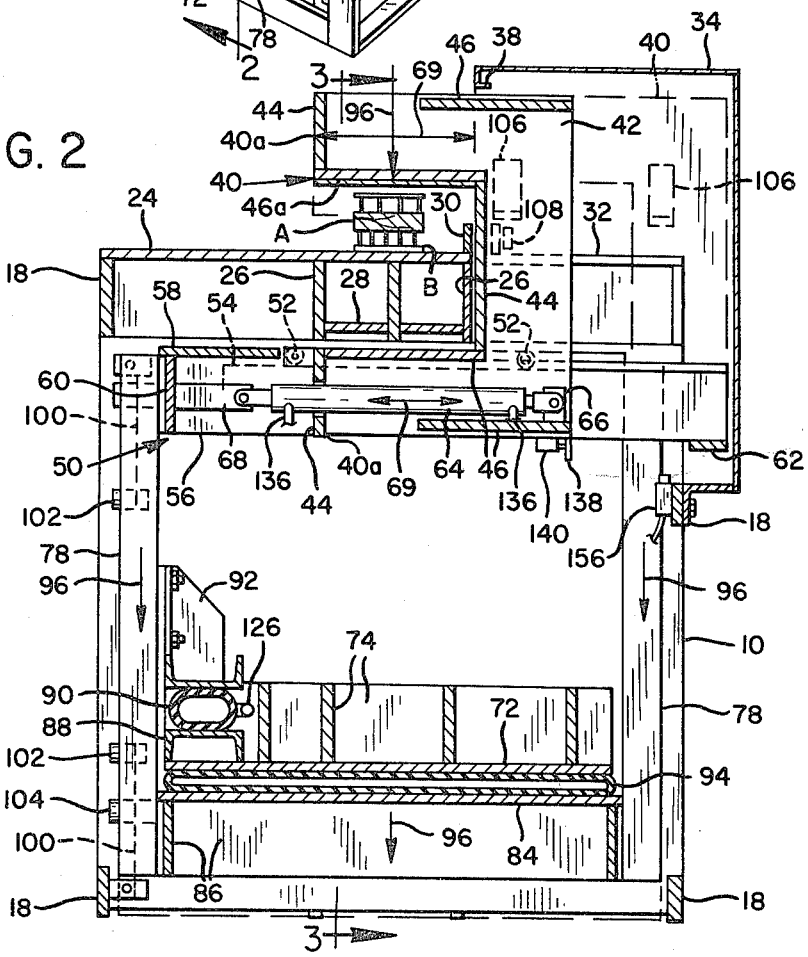
FIG. 2 is a vertical sectional view taken on the line 2—2 of FIG. 1.
Figure 3:
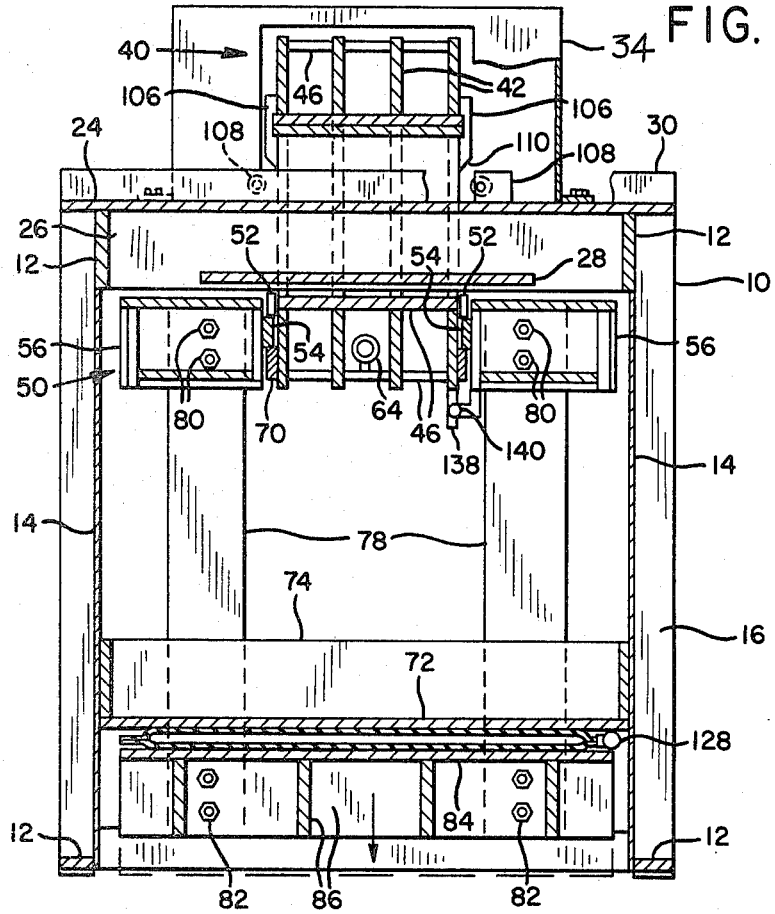
FIG. 3 is a vertical sectional view taken on the line 3—3 of FIG. 2.

With particular reference to FIGS. 1, 2 and 3, a press of the invention comprises a cabinet or housing 10 having a substantially heavy framework capable of producing and bearing a somewhat elevated pressure of platen load. Such framework comprises side frames made up of longitudinal frame members 12 with a solid plate wall 14 integrated on the inner side thereof and also including upright vertical reinforcing frame members 16. The side frames are connected by upper and lower lateral frame members 18 at the front and rear of the cabinet.

The cabinet has a top plate surface 24 which serves as a first or stationary platen surface. Platen 24 in the area of pressing forces, as will be more apparent hereinafter, is heavily reinforced by cross frame members 26 welded or otherwise fixedly secured thereto and welded or otherwise secured to the side frames. Frame members 26 have integral reinforcing plates or webs 28 therebetween. The top plate 24 supports a laterally extending upright guard 30 secured thereto at a point intermediate the front and rear of the press, and such top plate has a centralized opening 32 which extends rearwardly of the guard 30 and opens through the rear of the cabinet. An enclosed hood 34 having a flanged support 36 on the plate 24 extends over the slot 32 for enclosing a movable carriage structure, to be described. Hood 34 has a front opening 38.

A second platen assembly 40 includes a C-shaped carriage platen 40*a* with forwardly projecting upper and lower portions, the upper portion being arranged to project through the opening 38 in the hood 34 in a pressing position of the press but to be enclosed within the hood in a retracted position of the press. The lower portion of the press extends under the reinforced plate 24. Each of the upper and lower projecting portions has a plurality of vertical, C-shaped frame members 42 integrated into a rugged assembly by a plurality of upright plate-like frame members 44 and horizontal reinforcing plates or webs 46 integrated with the other members by welding or other suitable means. One of the horizontal reinforcing plates, designated by the numeral 46*a* and disposed on the underside of the horizontal opening formed by the C-shaped carriage, comprises a plate surface arranged to cooperate with the platen surface 24 for pressing articles, as will be more apparent hereinafter.

The carriage platen 40*a* is movably supported on a head portion 50 of the second platen assembly, and such support is by wheels 52 of the carriage operating on longitudinal tracks 54 integral with a pair of box-like side portions 56 of the head disposed on each side of the carriage and secured together at the front into a U-shaped structure by a horizontal cross frame member 58 and a vertical cross frame member 60. The box-like side portions 56 are secured together at the rear by a bottom cross frame member 62. Carriage platen 40*a* is driven forwardly and rearwardly by a double acting fluid operated cylinder 64 secured between an ear 66 integral with the carriage and an ear 68 integral with the head portion 50. Forward and retracting movements of the carriage platen 40*a* are shown by arrows 69 in FIG. 2. In this figure also, the carriage platen 40*a* is shown in full lines in a forward position capable of accomplishing a pressing function and is shown in broken lines in a retracted position in the hood.

Carriage platen 40*a* has a pair of integral longitudinal bars 70 on the sides thereof which are in sliding contact with the underside of the tracks 52. By such arrangement, the carriage will move downwardly when the head portion 50 moves down.

The cabinet 10 includes a lower horizontal stationary wall 72. Wall 72 is integrally secured such as by welding, to the reinforced side frames of the cabinet a short distance above the bottom of the cabinet. This wall is reinforced by vertical plates or webs 74. Head 50 has four depending arms 78 secured, as by bolts 80, to the corners thereof. The lower ends of these arms are secured, as by bolts 82, to a horizontal drive plate 84 disposed below the wall 72 and heavily reinforced by downwardly projecting plates or webs 86.

It is apparent that the second platen assembly includes the carriage platen 40*a*, the carriage supporting head 50, the depending arms 78, and the drive plate assembly 84. The wall 72 provides vertical support for the entire second platen assembly and also serves as a fixed abutment against which pressing forces are exerted. In providing the vertical support for the second platen assembly, wall 72 has a base member 88 secured across a front portion thereof for providing a supporting surface for a fluid operated expandable lifting bag 90. Bag 90 is disposed between this base member and a bracket 92 bolted or otherwise secured laterally to the two front arms 78. Upon expansion of the bag 90, the entire second platen assembly is arranged to be driven upwardly. A second fluid operated expandable pressing bag 94 is disposed between the stationary wall 72 and the plate 84 of the second platen assembly. Upon expansion of the bag 94 and contraction of bag 90, the second platen assembly is forced downwardly in a pressing function, namely, in the direction of arrow 96 in FIG. 2, and as will be seen hereinafter, pressing functions are accomplished by alternate operation of the bags 90 and 94. Downward movement of the second platen assembly pulls the carriage down through the engagement of tracks 52 with the bars 70.

Vertical stabilized movement of the second platen assembly is accomplished by upright shafts 100 on each side at the front, such shafts being integrated with the cabinet frame by means of ears 102 and being slidably engaged by bushing blocks 104 integral with the second platen assembly. It is also desired that the carriage platen 40*a* have precise or stabilized vertical movement in pressing operations. For this purpose, side surfaces of the two outermost frame members 42 of the carriage platen have roller tracks 106 secured thereto which are engageable by respective roller assemblies 108 secured to the top plate 24 of the cabinet. The bottom edges 110 of tracks 106 are chamfered to provide unimpaired engagement of the rollers with their tracks. The rollers and tracks are arranged such that when the second platen assembly moves downwardly the rollers and tracks will be in engagement and no side sway is possible. In the upper position of the second platen assembly, the tracks and rollers are out of engagement so that the carriage platen can freely retract.

The primary structural support for the cabinet 10 comprises the reinforced side wall frames and the upper and lower connecting frame members 18 at the front and rear. The reinforced side frames provide the necessary support for operation of the second platen assembly and its carriage platen 40*a* in all functions of the press. In addition, this particular structure allows the front and rear of the cabinet to include access doors, such as a door 112 shown in FIG. 1. Door 112 is broken away in this figure to show internal construction of the press. In addition to the specific structure of the framework as well as the structure of the second platen assembly utilizing the depending arms 78 and the lower drive plate 84, the space within the cabinet between upper and lower structural parts is substantially vacant whereby various plumbing and control portions for the drive system can be mounted and easily reached for installation or maintenance.

Figure 4:
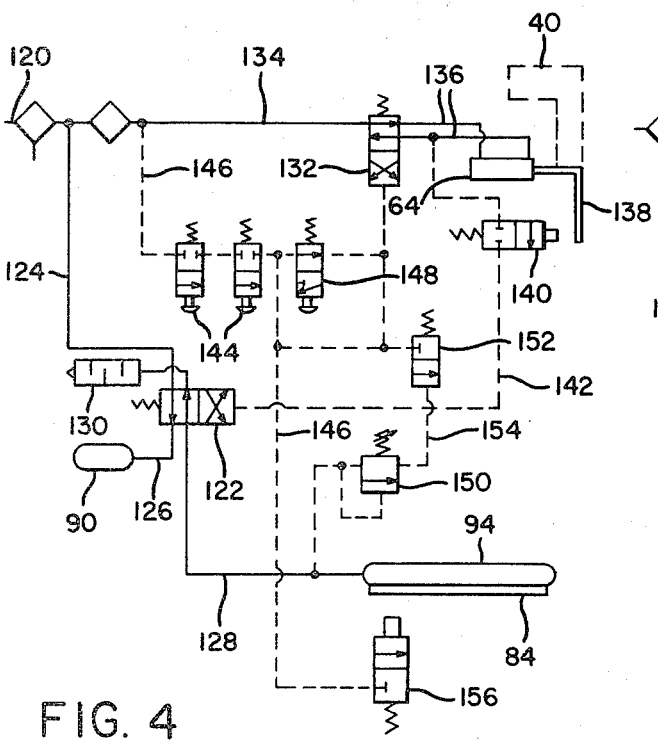
FIG. 4 is a schematic diagram of power and control circuits for operation of the press, this view showing the condition of the controls in a rest position of the press.
Figure 5:
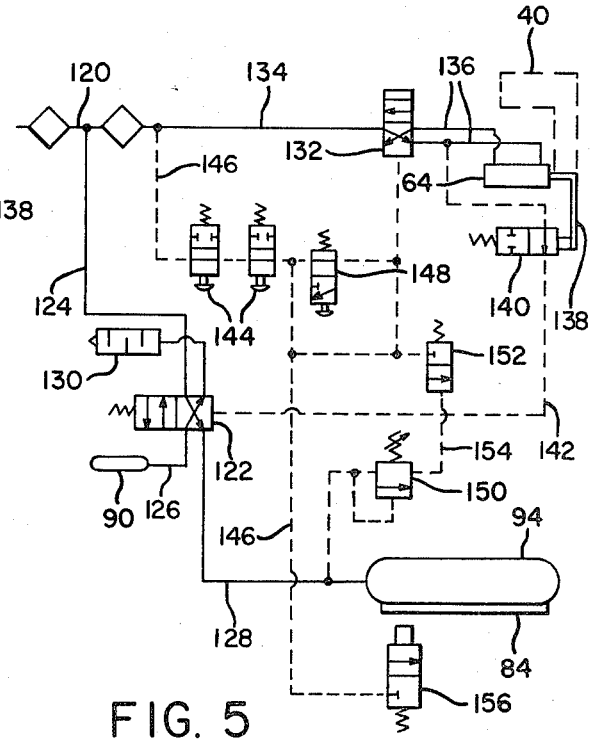
FIG. 5 is a view similar to FIG. 4 but showing the condition of the controls with the press in one stage of its operation.

The control circuitry for the operation of the press is shown in FIGS. 4 and 5, FIG. 4 showing the press in a rest position wherein the carriage platen 40*a* is retracted and FIG. 5 showing the press in an operating condition. The system shown for operating the press is a compressed air system, and although such a system is preferred because it is less expensive, quieter, and cleaner than hydraulic systems, it is understood than an hydraulic system could be employed.

A source 120 of compressed air is connected to the air bags 90 and 94 through a 4-way main valve 122. The system includes a conduit 124 leading from the source 120 to the valve 122 and auxiliary conduits 126 and 128 leading from the valve 122 to the bags 90 and 94, respectively. A muffler 130 is associated with the valve 122 to muffle exhaust from the bags. It will be noted in FIG. 4 that valve 122, in the rest position of the press, provides air to the lifting bag 90 but closes off air to the pressing bag 94. In this condition of the system, the bag 90 will cause the second platen assembly to be lifted to a non-pressing position. Air pressure source 120 also leads to a 4-way control valve 132, by means of a conduit 134, controlling the operation of carriage drive cylinder 64. Conduits 136 lead from the valve 132 to opposite ends of the cylinder 64 for driving it in opposite directions under the control of this valve. The second platen assembly has a switch engaging arm 138, also shown in FIG. 2, arranged to engage a pilot valve 140 having pilot control of valves 122 and 132 by a pilot line 142.

A pair of push button valves 144, comprising three-way valves plumbed in series, have pilot control with 4-way control valve 132 by means of a pilot line 146. An emergency three way stop valve 148 is also plumbed in this circuit. The three valves 144 and 148 are provided at the front of the machine, as shown in FIG. 1 for easy access to the operator. The series connection of the valves 144 require that both hands be used to start the press. A pressure relief valve 150 is also provided in the system and is connected to the 4-way control valve 132 through a pilot valve 152 by a pilot line 154. The system also includes a stroke limiting valve 156, also seen in FIG. 2, associated with the second platen assembly and positioned so that it is actuated at the exact point where it is desired that the downward movement of the press be stopped.

OPERATION

In the rest position of the press, such as when it is being loaded or unloaded, air pressure operates through valve 122 to the lifting bag 90. Bag 94 is deflated at this time. Air pressure also operates through valve 132 to the left side of cylinder 64 as viewed in broken lines in FIG. 2 so that the carriage platen 40*a* is retracted into the hood. An article A, such as lumber pieces to be spliced together by toothed plates B, is then placed on the stationary or first platen surface 24 in a position that will be under the second platen surface 46*a* in the outer position of the carriage platen 40*a*. The operator then presses the start buttons 144 to provide pilot pressure to the other side of cylinder 64 which causes the carriage platen 40*a* to move out of the hood to a position that is ready for pressing. When the carriage has moved forward as far as it can go, it contacts pilot valve 140 which actuates the 4-way main valve 122. The valve 122 then causes the lifting bag 90 to be deflated and the pressing bag 94 to be inflated. Inflation of the bag 94 causes the entire second platen assembly, together with the carriage platen 40*a*, to move downward so that the article under the upper platen 46*a* is pressed by it against the upper surface of the platen 24. If the upper platen assembly moves down far enough it will contact stroke limiting pilot valve 156 which when engaged exhausts the pilot line pressure to the valve 132. This reverses the pressure to the cylinder 64 and returns the carriage platen 40*a* to its position inside the hood. At the same time this switching of the 4-way control valve 132 exhausts the pilot line pressure to the pilot valve 140 and this reverses the 4-way main valve 122 causing the lifting bag to be inflated and the pressing bag 94 to be deflated. This action causes the second platen assembly to be lifted upward to its start position, thus completing the pressing cycle.

If the resistance to pressing is too great, the pressure in the pressing bag 94 will increase until it reaches the setting of the pressure relief valve 150. If such happens, the pilot valve 152 is actuated and this exhausts the pilot line pressure to the valve 132 causing it to reverse the cycle in the same manner as if the stroke limiting valve 140 had been actuated. Also, if the operator chooses to interrupt the pressing cycle and return the machine to its start position, he can do so by pressing the stop button 148. Pushing this button exhausts the pilot line pressure to the 4-way control valve 132 causing it to reverse the cycle.

When the cycle is completed and all parts are in the start position, the line to the carriage cylinder 64 remains pressurized so that the carriage is held firmly in a retracted position and no accidental pressing can take place. Pressing can occur only when the carriage is fully extended and has contacted the pilot valve 140.

With reference to FIGS. 6, 7 and 8, a modified pressing force is illustrated and employs the concept of using multiple fluid operated expandable bags 94' to provide the pressing force rather than a single bag. Five bags are shown in this embodiment but any desired number from two or more can be used. In this embodiment, the cabinet or housing 10' has a structurally strong front wall 158 and a structurally strong laterally extending, rearwardly spaced wall 160. The walls 158 and 160 support a plurality of horizontal stationary rigid abutment walls 162 spaced one above the other and associated with respective rigid drive plates 164 secured to upright tension rods 166 and disposed under their walls 162. The rods 166 extend slidably through apertures 168 in horizontal walls 162 and are secured integrally to the head portion 50. Rods 166 are spaced laterally across the press as necessary to maintain rigidity of plates 164 between them.

The upper portion of the press, including the specific structural details of the head portion 50, the C-shaped carriage platen 40*a* and other structure is the same as that shown in the FIG. 1 embodiment. Upward support of the head portion 50 is provided by one or more fluid operated expandable lift bags 90' supported on a base member 88' integral with a stationary wall 162, this lift bag bearing up against one of the plates 164.

Bags 94' are connected to air supply conduit 128 by means of an upright manifold conduit 172 having extensions 174, FIG. 8, with hollow tongues 176 communicating with the interior of extensions 174 and having end apertures 178. Open ends of bags 94' are fitted over the tongues and clamped securely in a sealing connection on the manifold extensions 176 by a pair of opposite plates 180 arranged to be clamped on opposite sides of the extension with the hose end in place. The hoses 94', manifold extensions 176 and clamp plates 180 have matching apertures 182 to receive clamp bolts 184 to hold this assembly of parts together in an airtight joint.

Operation of the press embodiment shown in FIGS. 6–8 is the same as that described in connection with the first embodiment. This latter embodiment has the advantage that a sufficient pressing power can be provided with a minimum front to rear dimension of the bags. At the same time pressing power can be centered directly below the pressing surface so that twisting forces are not applied to the platens and frame. Also, the pressing surface can be disposed close to the front of the machine, namely, close to the operator's station, for the utmost of convenience to the operator. The arrangement of FIGS. 6–8 provides a minimum of depth dimension of the press and also forms an empty interior compartment at the rear of the press, thus allowing operating and control elements to be mounted inside of the press. The multiple bag structure of FIGS. 6–8 also causes the pressing force to be applied without substantially increasing the stroke of the second platen assembly over that of a single bag.

The embodiments of the invention thus are simplified in structure but rugged in operation. Furthermore, the fluid operating exapandable type bags provide maximum power and fast operation. The designs are particularly suitable for operation by compressed air which is cleaner and faster than hydraulic power. The presses are compact in structure and furthermore have the advantage that the front top pressing surface allows multiple presses to be positioned selectively in the factory and plumbed together so that multiple-joint structural elements can be formed in one operation. Furthermore, the embodiment of FIGS. 6–8 with the extreme front pressing surface allows pairs of presses to be placed face to face if necessary to press joints that may be close together, such as in the formation of roof trusses.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A press construction comprising (a) a vertical support frame having top, bottom, front, rear and side portions, (b) a top reinforced surface on said frame forming a first platen surface, (c) a second platen assembly movable vertically in said support frame, (d) a carriage supported on said second platen assembly having a surface forming a second platen surface arranged to cooperate with the first platen surface for pressing articles, (e) said carriage having movement on said second platen assembly between a pressing position over said first platen surface and a retracted position, (f) and drive means disposed between said frame and said second platen assembly arranged to lift said second platen assembly to open said press and to pull said second platen assembly down to close said press.

2. The press construction of claim 1 wherein said drive means comprises a fluid operated expandable bag.

3. The press construction of claim 1 wherein said drive means comprises first drive means to lift said second platen assembly and second drive means to pull said second platen assembly down, each of said first and second drive means comprising fluid operated expandable bags.

4. The press construction of claim 3 including abutment means on said support frame disposed between the top and bottom thereof, said fluid operated bag of said first drive means bearing down against said abutment means and said fluid operated bag of said second drive means bearing up against said abutment means.

5. The press construction of claim 4 wherein said support frame comprises a cabinet having reinforced integral side walls supporting said top reinforced surface and said abutment means.

6. The press construction of claim 4 wherein said support frame comprises a cabinet having reinforced integral side walls supporting said top reinforced surface and said abutment means, the front and rear of said cabinet having access means to the interior of said cabinet.

7. The press construction of claim 1 wherein said drive means comprises first drive means to lift said second platen assembly and second drive means to pull said second platen assembly down, each of said first and second drive means comprising fluid operated expandable bags, an abutment member on said support frame disposed adjacent the bottom of the latter, said second platen assembly including an upper portion having said second platen surface thereon and also including a lower portion disposed under said abutment member and under said second fluid operated bag for downward driving movement upon expansion of said second fluid operated bag, and vertical arms connecting said upper and lower portions of said second platen assembly.

8. The press construction of claim 1 wherein said drive means comprises first drive means to lift said second platen assembly and second drive means to pull said second platen assembly down, each of said first and second drive means comprising fluid operated expandable bags, an abutment member on said support frame disposed adjacent the bottom of the latter, said support frame comprising a cabinet having reinforced integral side walls supporting said top reinforced surface and said abutment member, said second platen assembly including an upper portion having said second platen surface thereon and also including a lower portion disposed under said abutment member and under said second fluid operated bag for downward driving movement upon expansion of said second fluid operated bag, and vertical arms connecting said upper and lower portions of said second platen assembly in spaced relation in said cabinet to form an area in said cabinet for mounting operating and control mechanism.

9. The press construction of claim 1 wherein said drive means comprises first drive means to lift said second platen assembly and second drive means to pull said second platen assembly down, each of said first and second drive means comprising fluid operated expandable bags, an abutment member on said support frame disposed adjacent the bottom of the latter, said second platen assembly including an upper portion having said second platen surface thereon and also including a lower portion disposed under said abutment member and under said second fluid operated bag for downward driving movement upon expansion of said second fluid operated bag, vertical arms connecting said upper and lower portions of said second platen assembly, and guide means connected between said frame and said second platen assembly to guide the latter in a stable vertical direction.

10. The press construction of claim 1 including fluid operated drive means connected between said second platen assembly and said carriage for driving the latter between said pressing and retracting positions.

11. The press construction of claim 1 including vertical guide means between said support frame and said carriage for guiding the latter in a stable vertical direction in closing movements of said press.

12. The press construction of claim 1 wherein said drive means comprises first drive means to lift said second platen assembly and second drive means to pull said second platen assembly down, each of said first and second drive means comprising fluid operated expandable bags, and operating and control means associated with said fluid operated bags causing the bag of said first drive means to be expanded and simultaneously causing the bag of said second drive means to be collapsed and vice versa, to open and close said press.

13. The press construction of claim 1 wherein said drive means comprises first drive means to lift said second platen assembly and second drive means to pull said second platen assembly down, each of said first and second drive means comprising fluid operated expandable bags, and operating and control means associated with said fluid operated bags and causing the bag of said first drive means to be expanded and simultaneously causing the bag of said second drive means to be collapsed and vice versa, to open and close said press, said operating and control means being arranged to cause said second drive means to remain collapsed and said first drive means to remain expanded until such time that said carriage has moved fully to a pressing position.

14. The press construction of claim 1 wherein said drive means comprises first drive means to lift said second platen assembly and second drive means to pull said second platen assembly down, said second drive means comprising a plurality of fluid operated expandable bags, said bags being disposed vertically in spaced relation one above the other substantially directly below said first platen surface.

15. The press construction of claim 1 wherein said drive means comprises first drive means to lift said second platen assembly and second drive means to pull said second platen assembly down, said second drive means comprising a plurality of horizontal abutment members on said frame disposed in spaced relation one above the other below said first platen surface, support means integrated with said second platen means in depending relation, said support means extending down past said abutment members and having free movement relative to said members, a horizontal drive plate secured to said support means under each of said abutment members, and a fluid operated expandable bag between each of the respective pairs of abutment members and drive plates.

16. The press construction of claim 15 wherein said abutment members and drive plates are disposed vertically below said first platen surface.

17. A press construction comprising (a) a vertical support frame having top, bottom, front, rear and side portions, (b) a top reinforced surface on said frame forming a first platen surface, (c) a second platen assembly movable vertically in said support frame, (d) said second platen assembly having a surface above said first platen surface forming a second platen surface arranged to cooperate with the first platen surface for pressing articles, (e) first and second drive means disposed between said frame and said second platen assembly, (f) each of said first and second drive means comprising fluid operated expandable bags, (g) an abutment member on said support frame disposed adjacent the bottom of the latter, (h) said second platen assembly including an upper portion having said second platen surface thereon and also including a lower portion disposed under said abutment member and under said second fluid operated bag for downward driving movement upon expansion of said second fluid operated bag, (i) and vertical arms connecting said upper and lower portions of said second platen assembly.

18. The press construction of claim 17 wherein said support frame comprises a cabinet having reinforced integral side walls supporting said top reinforced surface and said abutment member.

19. The press construction of claim 17 wherein said second drive means comprises a plurality of said fluid operated expandable bags, said bags being disposed vertically in spaced relation one above the other substantially directly below said first platen surface.

20. The press construction of claim 17 wherein said second drive means comprises a plurality of said fluid operated expandable bags, a plurality of horizontal abutment members on said frame disposed in spaced relation one above the other below said first platen surface, support means integrated with said second platen means in depending relation, said support means extending down past said abutment members and having free movement relative to said members, and a horizontal drive plate secured to said support means under each of said abutment members, one of said fluid operated expandable bags being disposed between each of the respective pairs of abutment members and drive plates.

21. The press construction comprising (a) a support frame, (b) a first platen surface on said frame, (c) a second platen assembly on said frame movable relative to said first platen surface for pressing articles, (d) and a plurality of fluid operated expandable bags operative between said support frame and said second platen assembly for advancing the latter toward said first platen surface, (e) said plurality of fluid operated bags being disposed in spaced relation from each other in the direction of movement of said second platen assembly, (f) and power drive means for said bags operating to simultaneously apply pressing power to said bags to provide a multiple bag pressing force for said second platen assembly in alignment with the spaced direction of said bags, (g) the spacing of said bags from each other causing said pressing force to be applied without substantially increasing the stroke of the second platen assembly over that of a single bag.

* * * * *